US007597243B2

(12) United States Patent
Tsai

(10) Patent No.: US 7,597,243 B2
(45) Date of Patent: Oct. 6, 2009

(54) PACKING BOX

(75) Inventor: Ya-Fen Tsai, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/019,899

(22) Filed: Jan. 25, 2008

(65) Prior Publication Data

US 2009/0108054 A1 Apr. 30, 2009

(30) Foreign Application Priority Data

Oct. 30, 2007 (CN) ..... 2007 1 0202312

(51) Int. Cl.
*B65D 5/38* (2006.01)
*B65D 5/50* (2006.01)

(52) U.S. Cl. ..... 229/125.125; 206/754; 206/755; 206/760; 206/761

(58) Field of Classification Search ..... 229/125.125, 229/129.1; 206/738, 754, 755, 758–761, 206/765, 736

See application file for complete search history.

(56) References Cited

U.S. PATENT DOCUMENTS 1,928,889 A * 10/1933 Guyer ..... 229/125.125
2,410,161 A * 10/1946 Helbein ..... 206/758
2,755,982 A * 7/1956 Lugt, Jr. ..... 229/125.125
3,390,760 A * 7/1968 Brown ..... 229/125.125
3,648,918 A * 3/1972 Van Inwagen ..... 229/125.125
3,918,577 A * 11/1975 Horzick ..... 206/216
3,974,956 A * 8/1976 Delang ..... 206/738
4,049,117 A * 9/1977 Grimm ..... 229/129.1
6,168,073 B1 * 1/2001 Towle ..... 229/125.125
6,676,013 B2 * 1/2004 Auclair ..... 229/125.125
7,377,385 B2 * 5/2008 Giannini et al. ..... 229/125.125

* cited by examiner

*Primary Examiner*—Gary E Elkins
(74) *Attorney, Agent, or Firm*—Zhigang Ma

(57) ABSTRACT

An exemplary box includes two sleeves and a receptacle sleeved with the sleeves. Each sleeve includes a bottom wall, a top wall, and two sidewalls perpendicular to the top and bottom walls. The receptacle includes a rack and two blocking plates depending from the sidewalls. The rack includes a support disposed between the blocking plates and parallel to the bottom walls of the sleeves, two engaging flanges at opposite sides of the support, and two wings connecting the engaging flanges to the support respectively. The engaging flanges are secured to the top walls of the sleeves respectively, and the support and the wings are suspended in the sleeves.

9 Claims, 4 Drawing Sheets

PACKING BOX

BACKGROUND

1. Technical Field

The present invention relates to a packing structure and, particularly, to a packing box for facilitating conveniently removing items therefrom.

2. Description of Related Art

Packing boxes are commonly used to protect fragile items during delivery. Typically, a box for packing an item is made from folded corrugated cardboard. A cushion is employed in the box as a buffer to provide protection against damage caused by a sudden incident during conveyance and handling. However, the item is firmly embedded in the cushion and the cushion is fittingly received in the box, which can make it difficult to remove the item from the box when desired.

What is needed, therefore, is a packing box for facilitating convenient removal of items therefrom.

SUMMARY

In accordance with a present embodiment, a box includes two sleeves and a receptacle sleeved with the sleeves. Each sleeve includes a bottom wall, a top wall, and two sidewalls perpendicular to the top and bottom walls. The receptacle includes a rack and two blocking plates depending from the sidewalls. The rack includes a support disposed between the blocking plates and parallel to the bottom walls of the sleeves, two engaging flanges at opposite sides of the support, and two wings connecting the engaging flanges to the support respectively. The engaging flanges are secured to the top walls of the sleeves respectively, and the support and the wings are suspended in the sleeves.

Other advantages and novel features will be drawn from the following detailed description of at least one preferred embodiment, when considered in conjunction with the attached drawings.

BRIEF DESCRIPTION OF THE DRAWINGS

Many aspects of the present box can be better understood with reference to the following drawings. The components in the drawings are not necessarily drawn to scale, the emphasis instead being placed upon clearly illustrating the principles of the present box. Moreover, in the drawings, like reference numerals designate corresponding parts throughout the several views.

DETAILED DESCRIPTION OF THE PREFERRED EMBODIMENT

Embodiments of the present box will now be described in detail below and with reference to the drawings.

Figure 1:
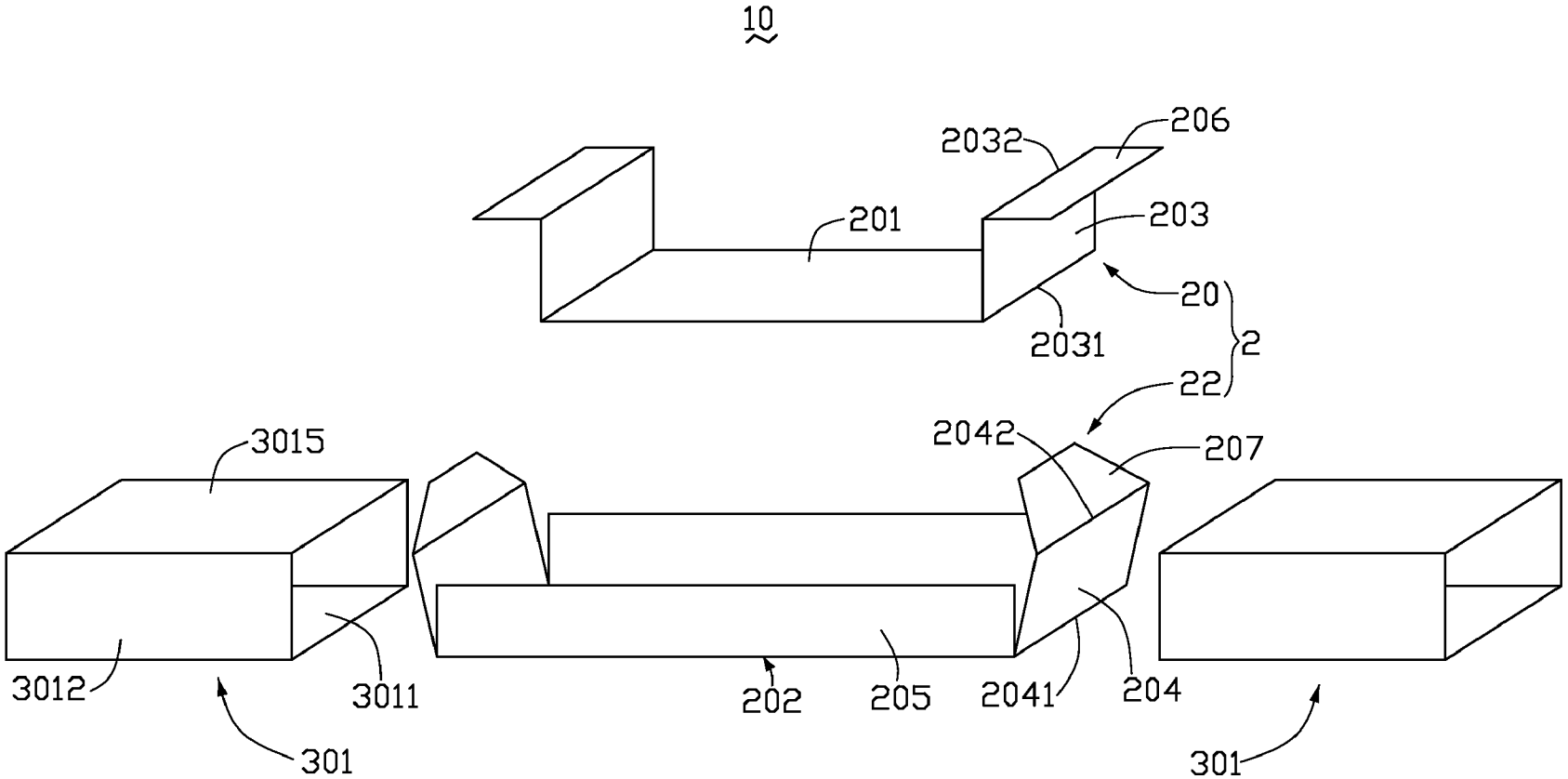
FIG. 1 is an exploded, isometric view of a box, according to an embodiment.
Figure 2:
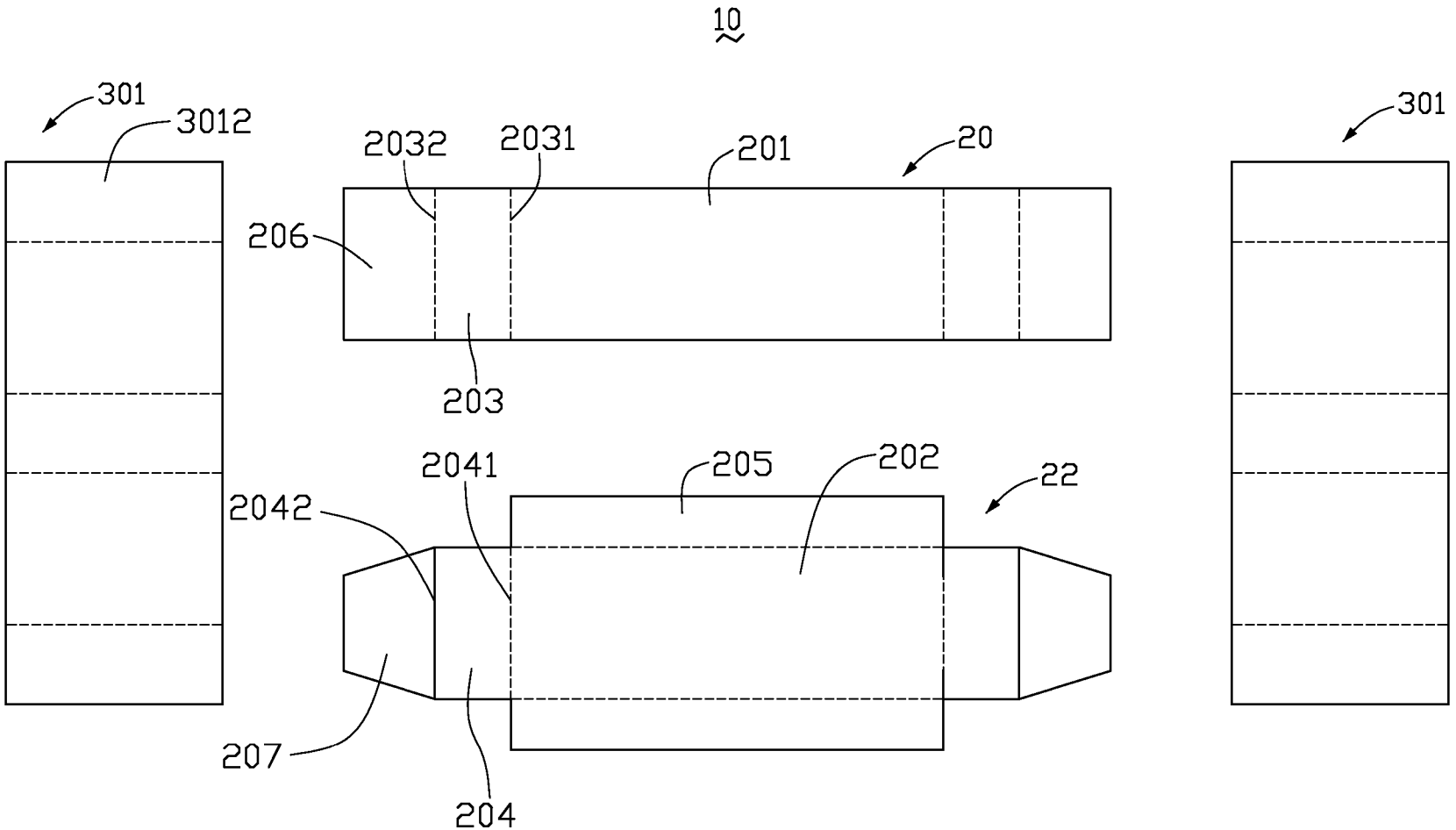
FIG. 2 is a top view of strips to form the box of FIG. 1.

Referring to FIGS. 1-2, a box 10 in accordance with an embodiment is shown. The box 10 comprises a receptacle 2 and two sleeves 301 sleeved around the receptacle 2. The receptacle 2 comprises a rack 20 for supporting an item (not shown) thereon, and an enclosure 22 for enclosing the rack 20 therein. The rack 20, the enclosure 22, and the sleeves 301 are formed by folded cardboard. The item received in the box 10 may be a camera, a mobile phone, or a personal digital assistant (PDA), etc.

The rack 20 comprises a horizontal support 201 for supporting an item thereon, two wings 203 angularly extending from opposite edges of the support 201, and two engaging flanges 206 angularly extending from distal ends of the wings 203. Two first creases 2031 are respectively defined between the support 201 and the wings 203, and two second-creases 2032 are respectively defined between the wings 203 and the engaging flanges 206. When forces are exerted on the engaging flanges 206 to elongate the rack 20, the support 201 is raised from a lower to a higher position, and the wings 203 rotate relative to the first and second creases 2031, 2032 respectively.

The enclosure 22 comprises a horizontal base 202, two flaps 204 angularly extending from opposite edges of the base 202, two engaging rims 207 angularly extending from distal ends of the flaps 204, and two blocking plates 205 extending from another two opposite edges of the base 202. Two first folds 2041 are respectively defined between the base 202 and the flaps 204, and two second-folds 2042 are respectively defined between the flaps 204 and the engaging rims 207. When forces are exerted on the engaging rims 207 to elongate the enclosure 22, the base 202 is raised from a lower to a higher position, and the flaps 204 rotate relative to the first and second folds 2041, 2042 respectively. Depths of the flaps 204 of the enclosure 22 are greater than that of the wings 203 of the rack 20.

The sleeves 301 are formed by folded cardboard. Each sleeve 301 allows an end portion of the receptacle 2 to enter therein, and comprises a bottom wall 3011, a top wall 3015, and two opposite sidewalls 3012 disposed between and perpendicular to the top and bottom walls 3011, 3015. The blocking plates 205 of the enclosure 22 depend from the sidewalls 3012 of the sleeves 301, and prevent the item from falling away from the support 201, especially when the box 10 is in an open state. It is understood in other embodiments, the blocking plates 205 can be directly formed by extension from another two opposite edges of the support 201, and the enclosure 22 can thus be omitted.

Figure 3:
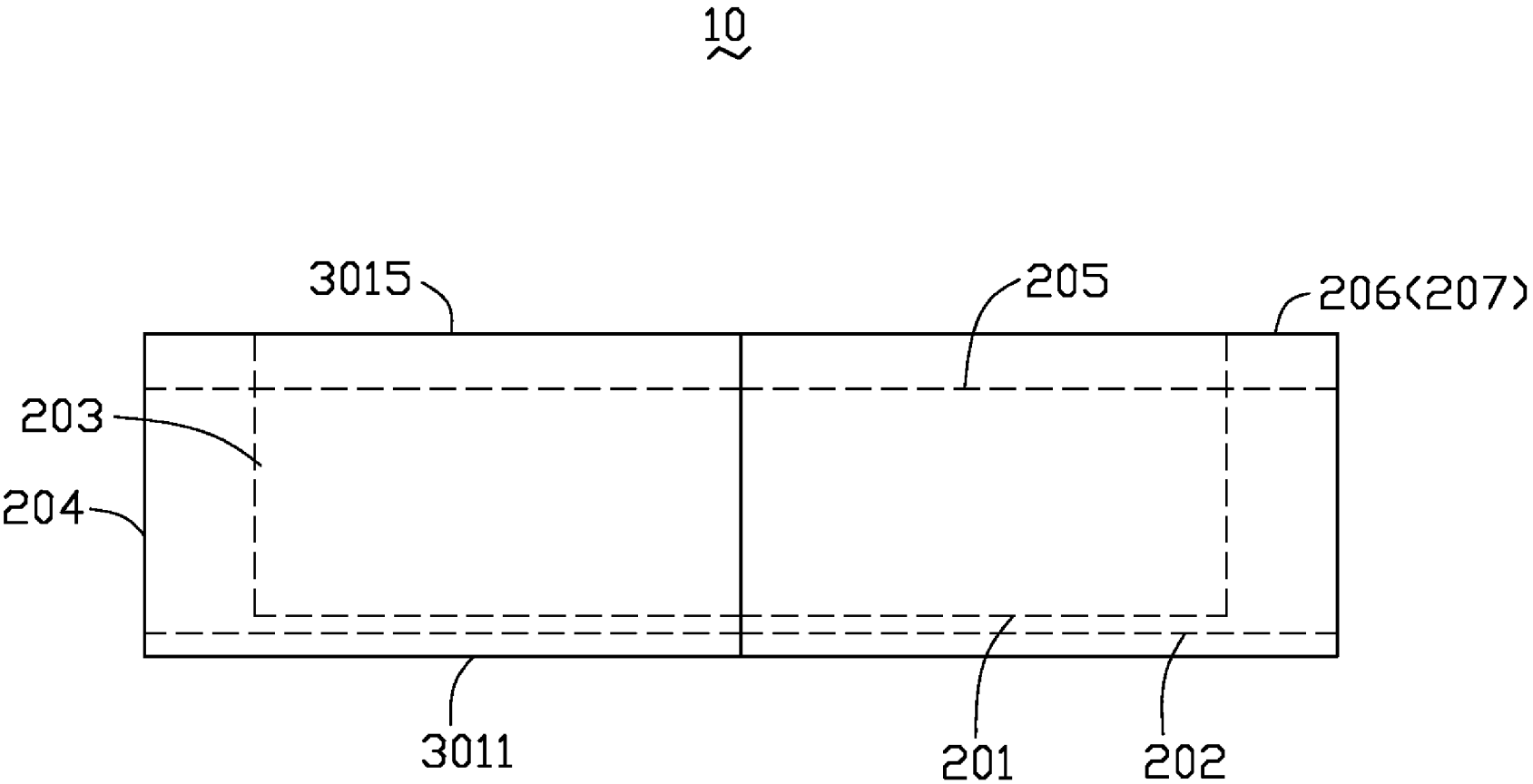
FIG. 3 is a side view of the box of FIG. 1, which is in a closed state.

Referring also to FIG. 3, the box 10 is in a closed state. Each sleeve 301 is sleeved around half of the receptacle 2. The engaging flanges 206 and the engaging rims 207 are secured to the top walls 3015 of the sleeves 301, and are parallel to the support 201 and the base 202. The support 201, the wings 203, the base 202, and the flaps 204 are suspended in the sleeves 301. In the embodiment, the engaging flanges 206 are disposed higher than the engaging rims 207. It is well understood the engaging rims 207 can instead be disposed higher than the engaging flanges 206. The support 201 and the wings 203 of the rack 20 are disposed within the enclosure 22 and correspond to the base 202 and the flaps 204 respectively. The support 201 is disposed above the base 202 and between the blocking plates 205, and the wings 203 are disposed between and spaced from the flaps 204.

Figure 4:
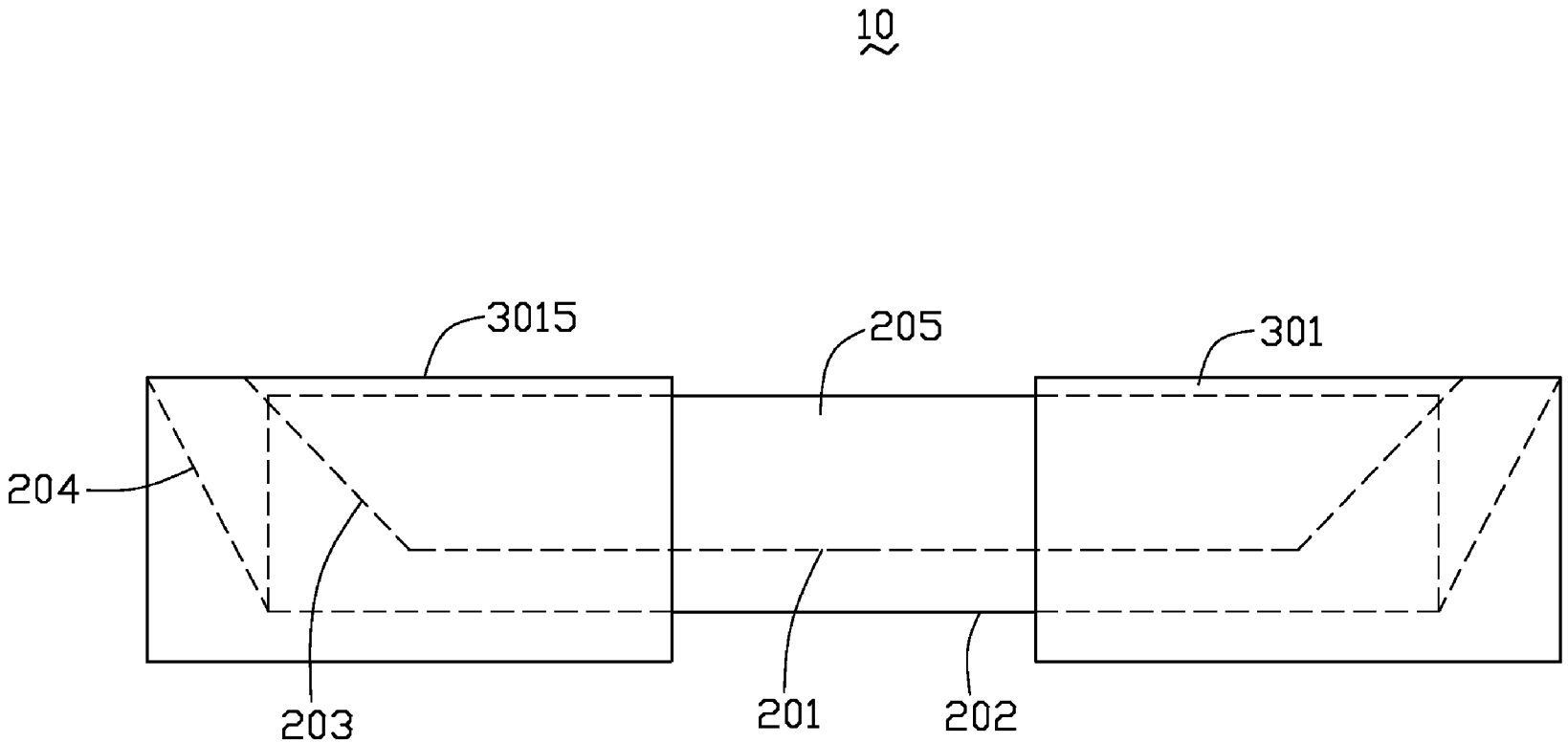
FIG. 4 is similar to FIG. 3, but the box is in an open state.

Referring also to FIG. 4, the box 10 is in the open state. The engaging flanges 206 and the engaging rims 207 move outwardly along with an outward motion of the sleeves 301. The movement of the engaging flange 206 outwardly, upwardly stretches the wings 203, and brings about an upward movement of the support 201. The movement of the engaging rims 207 outwardly, upwardly stretches the flaps 204, and brings about an upward movement of the base 202. Because the depths of the wings 203 are less than that of the flaps 204, travel distance of the support 201 is greater than that of the base 202. The item supported on the support 201 is thereby raised to protrude from the top wall 3015 of the sleeves 301 due to the upward movement of the support 201, and can be conveniently removed from the box 10.

The box 10 can additionally be used as an exhibiting bracket for exhibiting the item received therein, so long as the box 10 in an open state as shown in FIG. 4 and is held up by an end of one sleeve 301. At this time, an inner edge of the top wall 3015 of the one sleeve 301 standing up functions as a support for supporting a lateral side of the item, and the blocking plates 205 blocks longitudinal sides of the item.

It will be understood that the above particular embodiments and methods are shown and described by way of illustration only. The principles and features of the present invention may be employed in various and numerous embodiments thereof without departing from the scope of the invention as claimed. The above-described embodiments illustrate the scope of the invention but do not restrict the scope of the invention.

What is claimed is:

1. A box comprising:

two sleeves each comprising a bottom wall, a top wall, and two sidewalls perpendicular to the top and bottom walls; and a receptacle sleeved within the sleeves, the receptacle comprising a rack and two blocking plates, the blocking plates depending from the sidewalls, the rack comprising a support disposed between the blocking plates and parallel to the bottom walls of the sleeves, two engaging flanges at opposite sides of the support, and two wings connecting the engaging flanges to the support respectively, the engaging flanges being secured to the top walls of the sleeves respectively, the support and the wings being suspended in the sleeves.

2. The box as claimed in claim 1, wherein the receptacle comprises an enclosure, which comprises a base, and the blocking plates extend from opposite edges of the base.

3. The box as claimed in claim 2, wherein the enclosure comprises two flaps extending from another opposite edges of the base and suspended in the sleeves, and two engaging rims extending from distal ends of the flaps and secured to the top walls of the sleeves respectively.

4. The box as claimed in claim 3, wherein depths of the flaps are greater than that of the wings.

5. The box as claimed in claim 3, wherein the base and the flaps are suspended in the sleeves.

6. The box as claimed in claim 3, wherein the support and the wings of the rack are disposed within the enclosure, and correspond to the base and the flaps respectively.

7. The box as claimed in claim 6, wherein two first folds are respectively defined between the base and the two flaps, and two second folds are respectively defined between the two flaps and the two engaging rims, so that the base is capable of being raised from a lower to a higher position and the flaps are rotatable relative to the first and second folds.

8. The box as claimed in claim 6, wherein the support is disposed above the base, and the wings are disposed between and spaced from the flaps.

9. The box as claimed in claim 1, wherein two first creases are respectively defined between the support and the two wings, and two second creases are respectively defined between the two wings and the two engaging flanges, so that the support is capable of being raised from a lower to a higher position and the wings are rotatable relative to the first and second creases.

* * * * *